US009795024B2

(12) United States Patent
Crowe

(10) Patent No.: US 9,795,024 B2
(45) Date of Patent: Oct. 17, 2017

(54) PLASMA ARC TORCH NOZZLE WITH CURVED DISTAL END REGION

(71) Applicant: Thermacut, k.s., Uherske Hradiste (CZ)

(72) Inventor: George A. Crowe, Claremont, NH (US)

(73) Assignee: Thermacut, k.s., Uherske Hradiste (CZ)

( * ) Notice: Subject to any disclaimer, the term of this patent is extended or adjusted under 35 U.S.C. 154(b) by 160 days.

(21) Appl. No.: 14/273,590

(22) Filed: May 9, 2014

(65) Prior Publication Data

US 2014/0346151 A1 Nov. 27, 2014

Related U.S. Application Data

(60) Provisional application No. 61/826,615, filed on May 23, 2013.

(51) Int. Cl.
*H05H 1/34* (2006.01)
*H05H 1/28* (2006.01)

(52) U.S. Cl.
CPC ..... *H05H 1/3405* (2013.01); *H05H 1/28* (2013.01); *H05H 1/34* (2013.01); *H05H 2001/3457* (2013.01); *H05H 2001/3478* (2013.01)

(58) Field of Classification Search
CPC .. H05H 1/26; H05H 1/28; H05H 1/32; H05H 1/34; H05H 1/3405
USPC ..... 219/121.48–121.52; 313/231.41, 231.51, 313/111.21
See application file for complete search history.

(56) References Cited

U.S. PATENT DOCUMENTS

| | | | | |
|---|---|---|---|---|
| 5,208,448 | A * | 5/1993 | Everett | H05H 1/28 219/121.39 |
| 5,278,388 | A | 1/1994 | Huang | |
| 7,544,913 | B2 * | 6/2009 | Helenius | H05H 1/28 219/121.48 |
| 8,395,077 | B2 | 3/2013 | Duan et al. | |
| 8,513,565 | B2 | 8/2013 | Duan | |
| 2005/0133484 | A1 | 6/2005 | Delzenne | |
| 2009/0026180 | A1 * | 1/2009 | Yang | B23K 10/00 219/121.49 |
| 2009/0045174 | A1 | 2/2009 | Haberler et al. | |

(Continued)

FOREIGN PATENT DOCUMENTS

| | | | |
|---|---|---|---|
| EP | 2286952 | A1 | 2/2011 |
| WO | 2005027594 | A1 | 3/2005 |

*Primary Examiner* — David Angwin
*Assistant Examiner* — Justin Dodson
(74) *Attorney, Agent, or Firm* — Jeffrey E. Semprebon

(57) ABSTRACT

A nozzle for a plasma arc torch is provided with a distal region sidewall formed by rotation of a variably curved element about a nozzle axis. The distal region sidewall has an inclination to the nozzle axis that increases at an increasing rate as it approached a nozzle terminal plane that terminates an orifice of the nozzle. The distal region sidewall is substantially tangent to the nozzle terminal plane where it intersect the same. The desired curvature can be formed by rotation of a portion of an ellipse or parabola. The curvature of the distal region sidewall appears to draw a portion of the shield gas along the nozzle to provide improved cooling and greater stability to the plasma arc, which can improve the quality of cuts made by the arc and can increase nozzle life.

16 Claims, 8 Drawing Sheets

(56) References Cited

U.S. PATENT DOCUMENTS

2009/0255909 A1* 10/2009 Duan ..... H05H 1/34
219/121.5
2012/0256107 A1* 10/2012 Papamoschou ..... F01D 17/105
251/118

* cited by examiner

-Prior Art-

-Prior Art-

-Prior Art-

-Prior Art-

PLASMA ARC TORCH NOZZLE WITH CURVED DISTAL END REGION

FIELD OF THE INVENTION

The present invention is a nozzle for a plasma arc torch.

BACKGROUND OF THE INVENTION

Plasma arc torches frequently employ a shield in combination with a nozzle to direct a shield gas onto an ionized plasma stream flowing from a plasma torch. Some of these shields have been configured to direct the shield gas normal to the path of the ionized plasma, which is felt to provide enhanced cooling and protection of the nozzle from slag, while others direct the shield gas to move substantially parallel to the ionized plasma gas, which is felt to enhance the stability of the plasma arc to improve the quality of the cut and avoid undue wear on the electrode of the torch caused by erosion. An alternative approach, used by ESAB AB in torches such as its PT-19™ model, is to direct the shield gas toward the plasma arc at an angle that intersects the arc above the work-piece, to provide a balance between the benefit of cooling and protection of the nozzle, and the benefit of stability of the resulting arc. These approaches are all discussed in U.S. Pat. No. 8,395,077, which teaches a preferred range of geometries for a shield and nozzle combination which direct the gas at an angle.

FIG. 1 is a stylized section view showing a portion of a prior art plasma arc torch 10 that directs the shield gas at an angle, such as taught in the '077 patent. The torch has a nozzle 12 having a distal end region 14 with a conical exterior surface 16, where the cone is defined by a prescribed range of half angle $\alpha$ of the cone with respect to a nozzle axis 18. A matched shield 20 has a conical interior surface 22 with a similar half angle $\beta$. The combination of the conical exterior surface 16 of the distal end region 14 and the conical inner surface 22 of the shield 20 serve to form an angled annular passage 24 to direct the shield gas toward the ionized plasma at an angle $\gamma$ (determined by the angles $\alpha$ and $\beta$ of the nozzle and shield surfaces) with respect to the nozzle axis 18. The conical exterior surface 16 terminates at a distal end face 26 of the nozzle 12, this distal end face 26 circumscribing a nozzle orifice 28 and having an end face diameter $\Phi$1. The nozzle orifice 28 has a hydraulic diameter D, and the '077 patent includes preferred ratios of $\Phi$1:D in the various parameters that are intended to provide enhanced performance. The end face diameter $\Phi$1 and the angle $\gamma$ of the shield gas result in the gas intersecting the plasma arc at a merge point M.

SUMMARY OF THE INVENTION

The present invention is for a nozzle for a plasma arc torch that directs the shield gas so as to provide improved cooling and a more even distribution of the shield gas in order to provide enhanced cooling of the nozzle and reduced instability of the plasma arc compared to prior art nozzles.

The nozzle has a longitudinal nozzle orifice therethrough, which is symmetrically disposed about a longitudinal nozzle axis. The nozzle and the torch are provided with structural components that assure that, when the nozzle is attached thereto, the nozzle axis is coincident with a torch axis. The nozzle orifice terminates at a nozzle terminal plane that is perpendicular to the nozzle axis. Typically, a gas-directing component such as a shield or a deflector is attached to the torch and surrounds at least a portion of the nozzle, the shield or deflector serving to introduce cooling shield gas over the surface of the nozzle.

The nozzle has a distal end region with a variably-curved convex distal region sidewall, which terminates at the nozzle terminal plane; the distal region sidewall can terminate at the nozzle orifice or can join a distal end face that circumscribes the nozzle orifice and resides in the nozzle terminal plane. The distal region sidewall is a surface of rotation generated by rotation of a curvilinear element about the nozzle axis, where the curvilinear element has a variable (non-circular) convex curvature such that its inclination with respect to the nozzle terminal plane increases at an increasing rate as the curvilinear element approaches the nozzle terminal plane. Furthermore, the curvature of the curvilinear element is adjusted such that it is substantially tangent to the nozzle terminal plane where it intersects the same. In some embodiments, the curvilinear element is a portion of an ellipse, but alternative contours that approximate an ellipse could be employed to provide a smoothly changing curvature, such as parabolic or hyperbolic curves. When the curvature is not tangent to the nozzle terminal plane, its angle with respect to the plane at its point of intersection is preferably maintained sufficiently small as to provide a transition that is smooth enough to allow a portion of the shield gas to closely follow the surface of the nozzle. One expression of such smoothness is that there are no abrupt changes in the contour that would give rise to a discontinuity in the second derivative of the curve of the curvilinear element as it joins to the portion of the distal end region that resides in the nozzle terminal plane, this region being either the distal end face or the circle that defines the end of the nozzle orifice. Another expression of such smooth transition could be defined by a projected angle $\epsilon$ between the nozzle terminal plane and a line that is tangent to the curvilinear element at the point where the curvilinear element intersects the plane. Forming the distal end region with a sidewall defined by a curvilinear element having a small projection angle $\epsilon$ can allow greater freedom of design and may allow greater mass of the nozzle in the region surrounding the nozzle orifice.

The smooth curvature of the distal region sidewall serves to guide the shield gas and allow a significant portion of the shield gas to remain in close proximity to the portion of the distal end region that is in close proximity to the nozzle orifice in order to provide enhanced cooling of this portion of the nozzle. This tendency is believed to be due to the Coandă effect, in which a fluid acts as if attracted to a nearby surface; such attraction serves to maintain the fluid in contact with the surface if changes in the curvature of the surface are sufficiently gradual. The tendency to retain a portion of the shield gas in close proximity to the distal end region also serves to form a broader, more uniform distribution of the gas, which is believed to reduce instability caused by the shield gas impinging on the plasma arc. Increased stability of the arc may result in improved quality of the resulting cutting action, and the use of an elliptical surface has been shown in preliminary tests to greatly extend the useful life of the nozzle; this increase appears to be due to a combination of enhanced cooling of the nozzle and a reduction in the erosion of the nozzle orifice through which the arc passes, this reduction in erosion resulting from reduced instability of the plasma arc.

In some embodiments, the nozzle also includes a nozzle extension region that attaches to the distal end region. The nozzle extension region has an extension sidewall which is symmetrical about the nozzle axis, being formed by rotation about the nozzle axis of an extension element that can be straight or curvilinear. The nozzle extension region attaches to the distal end region such that the extension sidewall joins and extends the distal region sidewall. In many applications, it is preferred that the transition between the distal region sidewall and the extension sidewall to have a smooth transition to avoid disruption of the gas flow thereover. The smooth transition aids the gas flow in following the surface and helps prevent the flow from being disrupted as it passes over the junction between the sidewalls.

In some embodiments, the extension sidewall is defined by a curvilinear element that is further configured such that the inclination of the extension curvilinear element with respect to the nozzle axis increases as its separation from the nozzle terminal plane increases, forming a concave form for the extension sidewall. Having such a "concave" configuration of the extension sidewall may allow the nozzle extension region to be more massive. In other embodiments, the extension sidewall is formed with a variably-curved convex surface defined by rotation about the nozzle axis of a variably-curved extension curvilinear element, in which case the extension curvilinear element is preferably tangent to the curvilinear element that defines the distal end region where the two regions join.

When the torch has a gas-directing component, the gas-directing component has a coupling that attaches it to the torch, and partially surrounds the nozzle. When a shield is employed as the gas-directing component, the shield is configured to have a gas-directing inner surface which is in a spaced apart relationship to the distal region sidewall, which results in an annular passage between the nozzle and the shield through which a cooling gas will be passed in service. The gas-directing surface joins to a shield orifice which is symmetrically disposed about the nozzle axis and serves to allow passage of the plasma arc as well as the shield gas through the shield. When a conventional shield is employed, having a gas-directing surface that is conical, the curve of the distal region sidewall results in an increase in the separation between the distal region sidewall of the nozzle and the gas-directing surface of the shield as the shield gas approaches the end of the annular passage, where it is released. This increase in separation, combined with the tendency of the gas to follow along the smoothly-curved distal region sidewall, is felt to provide a more even distribution of the gas so as to reduce its adverse impact on the stability of the plasma arc, while still allowing a significant portion of the gas to remain in close proximity to the nozzle to enhance its ability to cool and protect the nozzle. The shield has a shield orifice symmetrically disposed about the torch axis, and it is typically preferred for the shield orifice to join the gas-directing surface in a radiused manner so as to further even the distribution of the gas and reduce turbulence so as to reduce the adverse impact of the shield gas on the stability of the plasma arc.

Having the nozzle and shield so configured provides multiple benefits in that the expanding separation between the nozzle and the shield more uniformly distributes the flow of the cooling gas compared to a passage bounded by straight-walled conical surfaces, which should reduce instability due to the shield gas impinging on the plasma arc. Additionally, the smooth transition between the distal region sidewall and the distal end face of the nozzle assists the gas in following along the surface of the nozzle to further enhance cooling to reduce the operating temperature of the nozzle distal end region, particularly in the region surrounding the nozzle orifice. The smooth flow and the more distributed gas flow resulting from expansion of the annular passage appears to move the center of the mass flow toward the distal end face of the nozzle as well as providing a more distributed flow of gas, both of which are felt to increase the stability of the ionized plasma and increase the heat extraction for the nozzle.

In applications where a deflector is employed as a gas-directing component rather than a shield, there are some distinctions as to the character of the gas-directing inner surface of the deflector, which extends over only a portion of the exterior surface of the nozzle. To help assure that the gas flow follows the exterior surface of the nozzle, the exterior surface should be contoured with smooth transitions between its sections. While the deflector again has its gas-directing surface positioned in a spaced-apart relationship with respect to the nozzle, the terminal edge of the deflector should not be rounded, and typically the gas-directing surface terminates at a right angle or an acute angle. In either case, this sharp angle reduces the tendency of the gas exiting from the deflector to be diverted from following along the exterior surface of the nozzle. In some embodiments, while the deflector is foreshortened with respect to the nozzle, it extends over a part of the distal end region of the nozzle.

This profile allows for a wider range of geometries to accommodate the designer's needs for flow, distribution and direction of shield gas.

Figure 5:
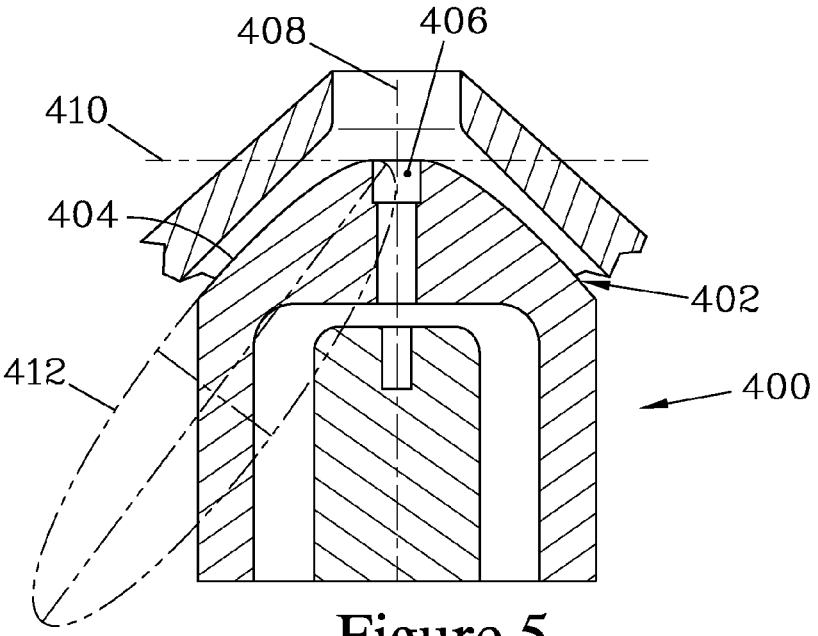

FIG. 5 is a section view of another embodiment of the present invention, a nozzle having a distal end region with a variably-curved convex distal region sidewall that serves to bound the nozzle orifice; in this embodiment, there is no distal end face. The distal region sidewall is defined by rotation of a portion of an ellipse that is substantially tangent to the nozzle terminal plane at the point where it intersects both the nozzle terminal plane and the nozzle orifice.

Figure 2:
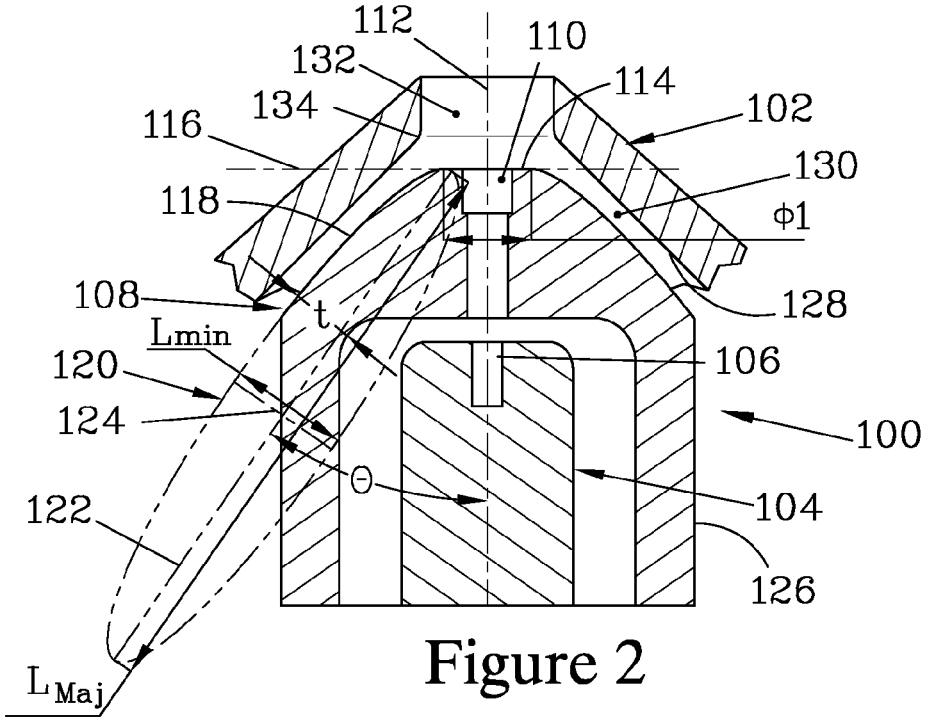
FIG. 2 is a section view that corresponds to the view of FIG. 1, but where the torch employs a nozzle that forms one embodiment of the present invention. In this embodiment, the nozzle has a distal end region that terminates at a distal end face extending in a nozzle terminal plane that is normal to a nozzle axis, and a nozzle orifice terminates at the distal end face. The distal end region has a variably-curved convex distal region sidewall that is formed as a surface of rotation generated by rotating a portion of an ellipse about the nozzle axis. The ellipse that serves as a curvilinear element to generate the surface of rotation has its major axis inclined with respect to the nozzle axis, and is positioned such that it intersects the nozzle terminal plane at a point where it is substantially tangent thereto. This point is typically in close proximity to one end of the major axis of the ellipse, and in this embodiment, is also where the distal region sidewall joins the distal end face.
Figure 6:
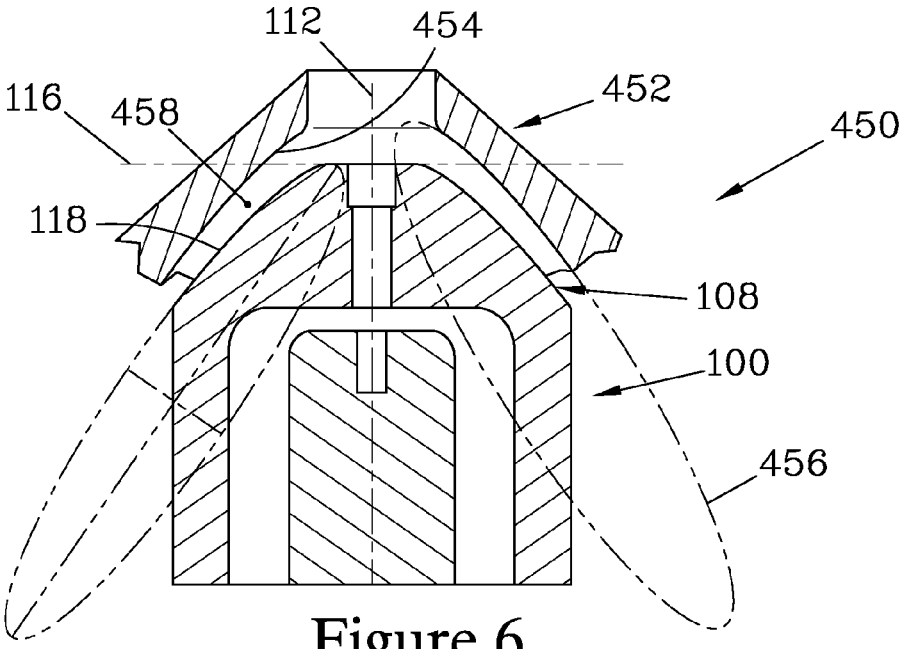

FIG. 6 is a section view showing the nozzle shown in FIG. 2 when employed with a novel shield having a curved gas-directing surface that is opposed to the distal region sidewall of the nozzle distal end region. The curve of the gas-directing surface is selected relative to the curve of the distal region sidewall such that these surfaces diverge as the distal region sidewall approaches the nozzle terminal plane and the distal end face that resides thereon. The use of a curved or faceted gas-directing surface on the shield allows for a more consistent spacing between the nozzle and shield.

Figure 7:
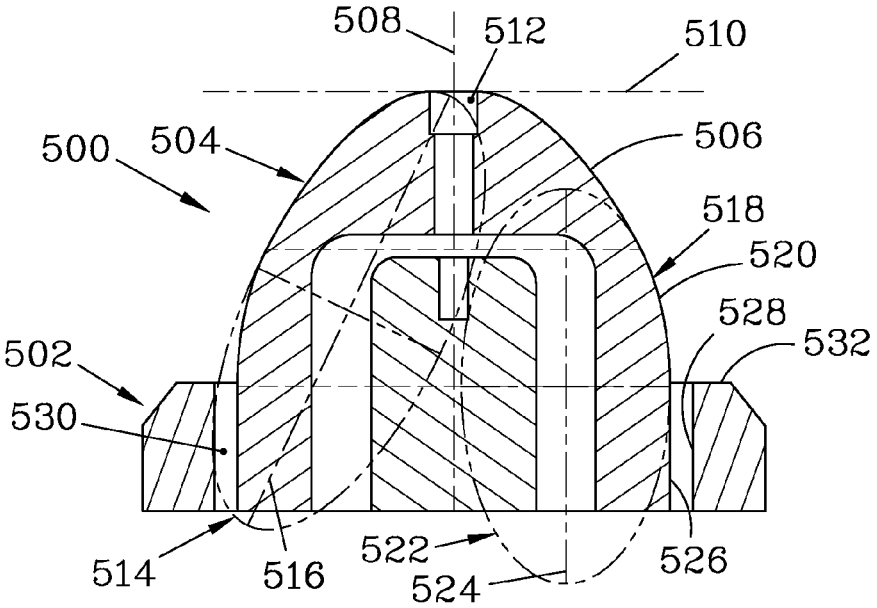

FIG. 7 is a section view illustrating a portion of a nozzle that forms another embodiment of the present invention, which has a distal end region joined to an extension region. While this embodiment could be employed with a shield, it is felt to maintain many of its benefits when used with a deflector that extends along only a portion of the nozzle. In this embodiment, the distal end and extension regions are configured to provide a smooth continuous convex curve to guide cooling shield gas over the nozzle. In this embodiment, the nozzle distal end region has a variably-curved convex distal region sidewall defined by a primary ellipse that has its major axis inclined with respect to the nozzle axis, and the extension region has an extension surface defined by a secondary ellipse that has its major axis parallel to the nozzle axis and which is tangent to the primary ellipse; this configuration provides a continuous convex surface for guiding the shield gas, while retaining a desired minimum thickness of the nozzle distal end region to facilitate heat transfer to effectively cool the nozzle.

Figure 8:
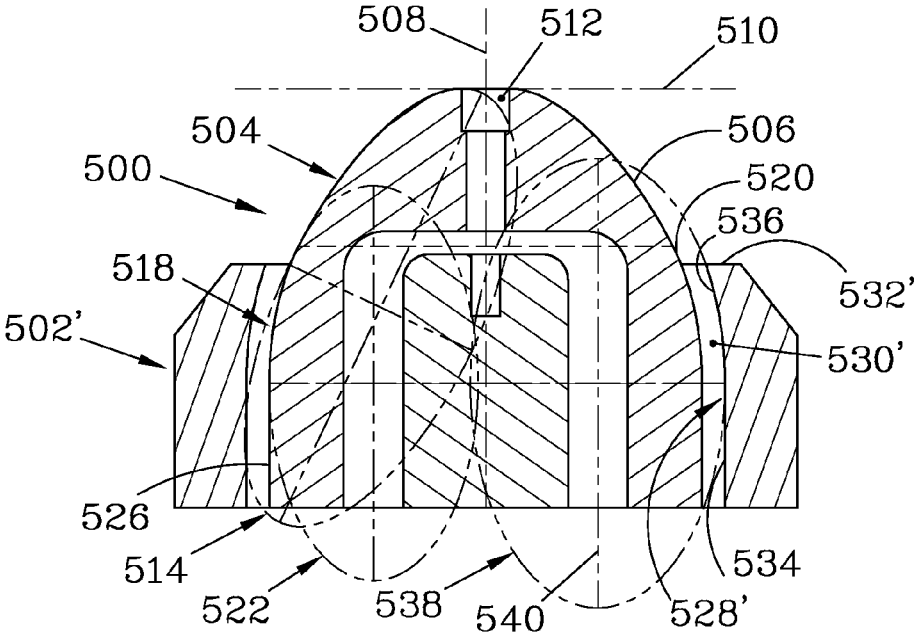

FIG. 8 is a section view illustrating the nozzle shown in FIG. 7, when employed with an extended deflector to further control the flow of the shield gas. The extended deflector has a terminal region with a gas-directing surface that is defined by a third ellipse, which has its major axis parallel to the nozzle axis and is configured to parallel the extension sidewall.

Figure 9:
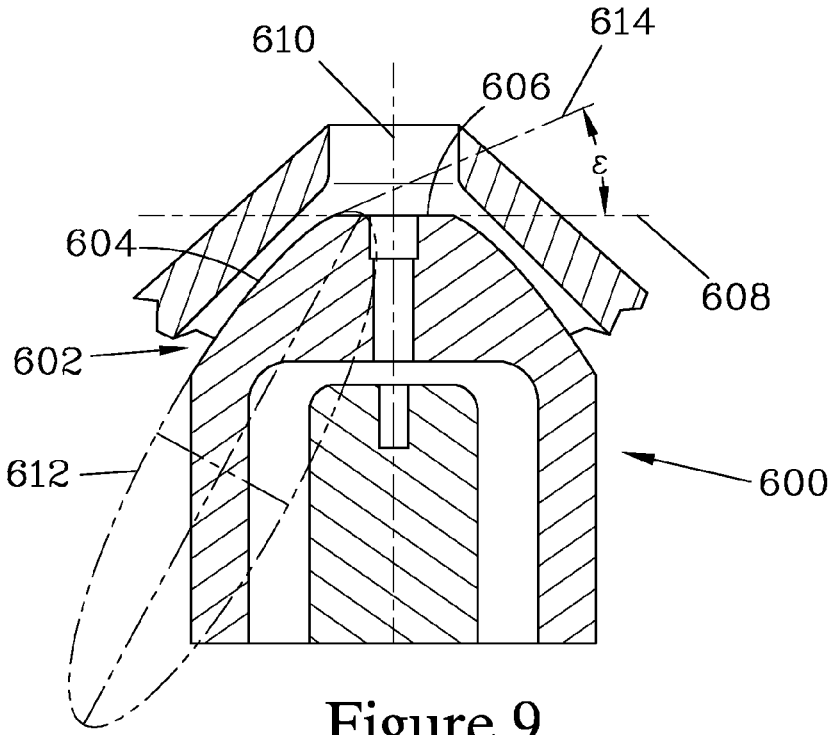

FIG. 9 is a partial section view of a nozzle that forms another embodiment of the present invention. The nozzle again has a distal end region with a distal region sidewall that is defined by rotation of a portion of an ellipse about a nozzle axis. However, in this embodiment the ellipse extends beyond a nozzle terminal plane rather than being tangent thereto. This results in the distal region sidewall intersecting a distal end face at a small angle rather than being tangent to the distal end face.

Figure 10:
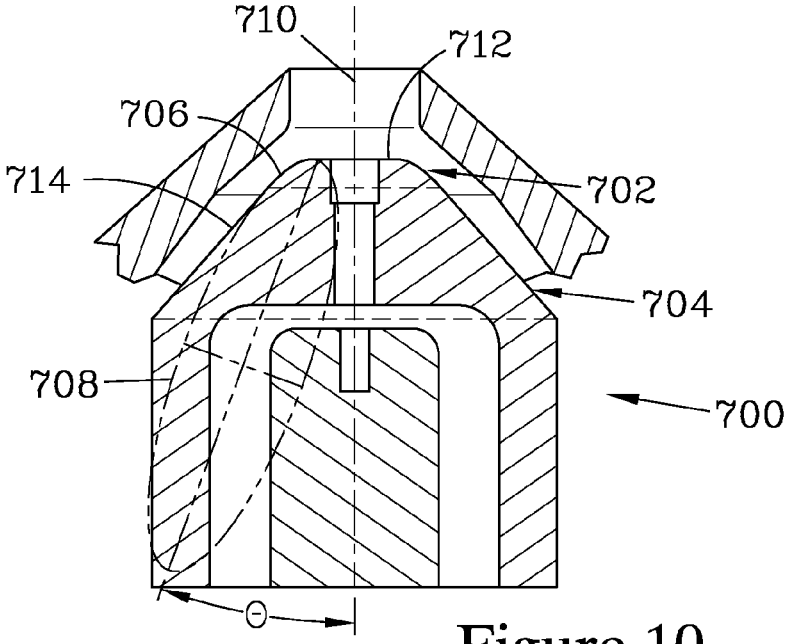

FIG. 10 is a partial section view of a nozzle that forms another embodiment of the present invention. This nozzle has a distal end region with a distal region sidewall defined by a portion of an ellipse, as well as an extension region that is frustoconical, having an extension sidewall that is defined by rotation of a line segment and is tangent to the distal region sidewall where the two sidewalls join.

Figure 11:
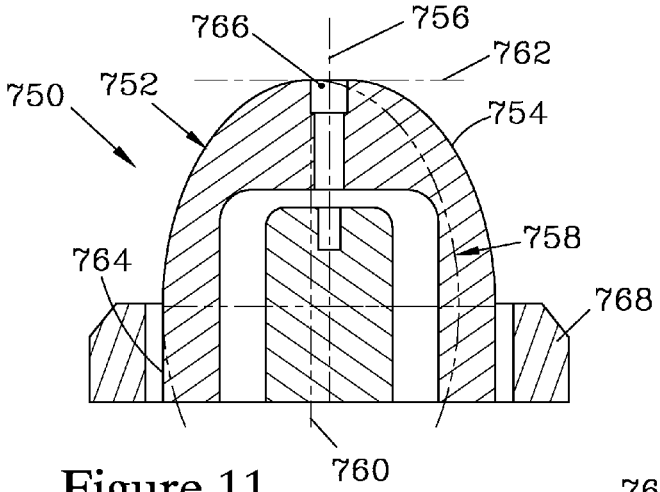

FIG. 11 is a partial section view showing a nozzle similar to that shown in FIGS. 7 and 8, but where the nozzle does not have an extension region. The nozzle has a distal end region defined by a portion of an ellipse that has its major axis oriented parallel to the nozzle axis, and configured such that it smoothly joins to a cylindrical sidewall and to the nozzle terminal plane.

Figure 12:
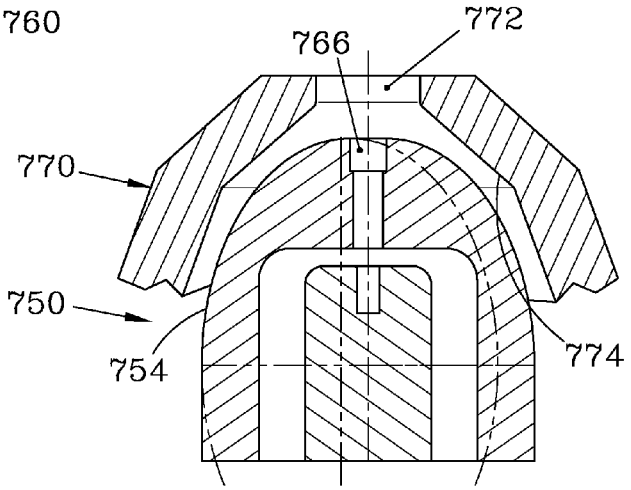

FIG. 12 illustrates the nozzle shown in FIG. 11 when employed in a torch having a shield that encloses the nozzle, rather than in a torch employing a deflector.

Figure 13:
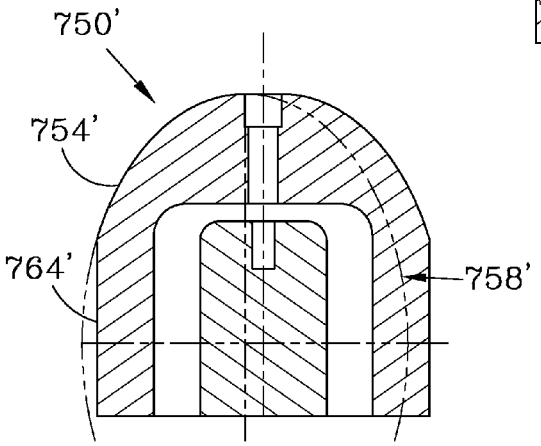

FIG. 13 illustrates a nozzle that is similar to that shown in FIGS. 11 and 12, but where the ellipse that defines the distal region sidewall is intersected by the cylindrical sidewall in a non-tangential manner.

Figure 1:
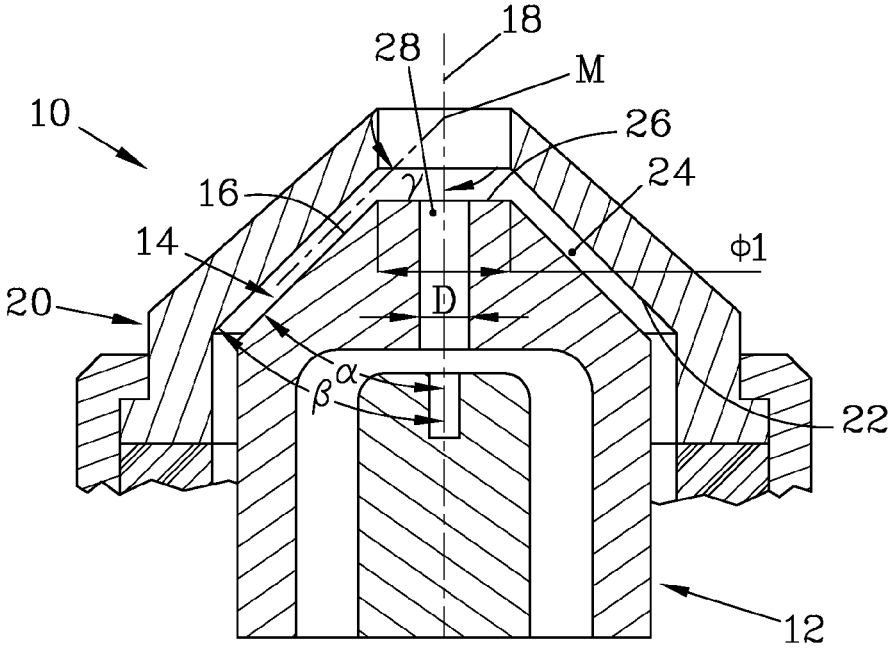
FIG. 1 is a longitudinal section view of a portion of a prior art plasma arc torch, showing a distal end region of a nozzle, as well as a shield and a portion of an electrode. The nozzle and the shield have opposed frustoconical surfaces that form an annular passage to direct shield gas such that the shield gas impinges on the plasma arc at an angle.
Figure 14:
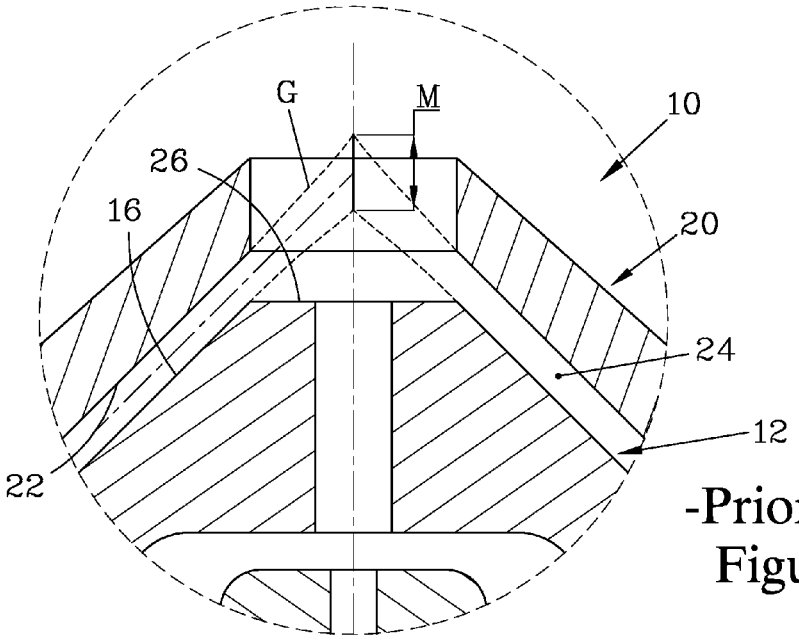
Figure 15:
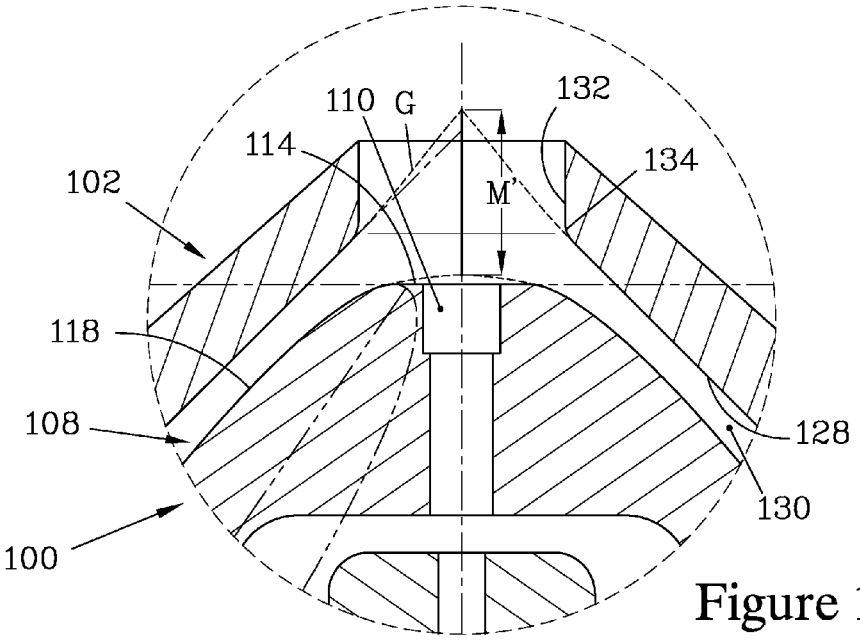

FIGS. 14 and 15 are schematic views representing a simplified interpretation of the gas flow that is believed to result from the nozzle and shield combinations shown respectively in FIGS. 1 and 2. In the prior art structure shown in FIGS. 1 and 14, the flow of shield gas separates from the nozzle at the point where the conical sidewall joins the distal end face, resulting in limited cooling of the distal end face and a relatively concentrated flow of gas that can cause instability of the plasma arc. In comparison, the smoothly-curved nozzle of the present invention shown in FIGS. 2 and 15 provides a smooth transition from the sidewall to the distal end face that promotes a portion of the gas flow following the curvature of the sidewall and remaining in close proximity thereto. This both enhances cooling of the region of the nozzle surrounding the nozzle orifice and provides a broader, more uniform distribution of the shield gas to reduce instability of the plasma arc, which appears to enhance cutting quality and greatly reduce erosion of the nozzle orifice.

Figure 16:
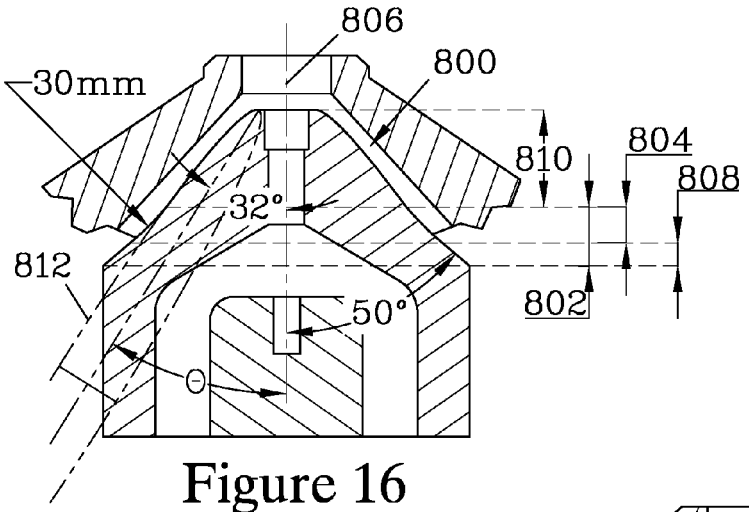
Figure 17:
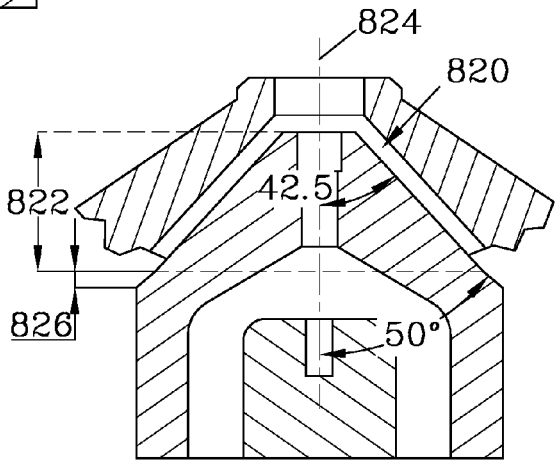

FIGS. 16 and 17 illustrate the exterior configurations of two 260 amp nozzles used in comparison testing to evaluate the benefit of the present invention; both nozzles were employed with the same shield and other torch components. FIG. 16 shows a nozzle of the present invention, having a distal region sidewall defined by a portion of an ellipse, and an extension region formed with a portion defined by a concave radius and a portion defined by a line segment. FIG. 17 shows a comparable prior art 260 amp nozzle, which has a slightly indented faceted configuration having a long frustoconical portion joining to a shorter frustoconical portion that has a slightly greater inclination to the nozzle axis.

Figure 18:
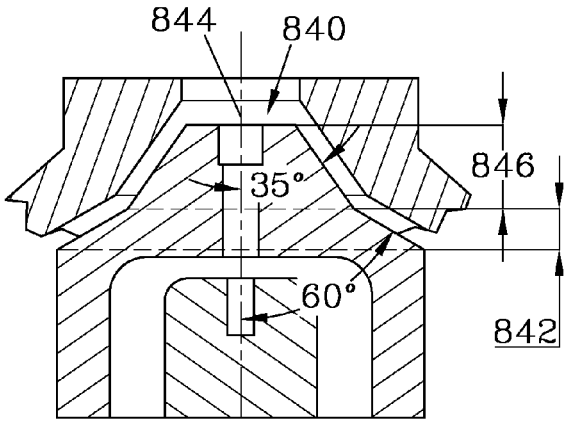

FIG. 18 illustrates the exterior configuration of a prior art 45 amp nozzle that was compared to a 45 amp nozzle of the present invention that had the configuration shown in FIG. 10. This nozzle has indented faceted configuration with a frustoconical distal end region joining to a frustoconical extension region, where the inclination of the extension region sidewall to the nozzle axis is substantially greater than the inclination of the distal region sidewall. This nozzle was employed with a shield having an inner surface configured to conform to the exterior contour of the nozzle.

DETAILED DESCRIPTION

FIG. 2 is a partial section view illustrating a portion of a nozzle 100 that forms one embodiment of the present invention. The nozzle 100 is employed in a plasma arc torch having a shield 102 (only a portion of which is illustrated) and an electrode 104 having an emissive insert 106.

The nozzle 100 has a distal end region 108 with a longitudinal nozzle orifice 110 therethrough. The nozzle 100 and the nozzle orifice 110 are symmetrically disposed about a longitudinal nozzle axis 112. The nozzle orifice 110 terminates at a distal end face 114, which has a diameter Φ1 and resides in a nozzle terminal plane 116 that is normal to the nozzle axis 112.

The nozzle distal end region 108 has a variably-curved convex distal region sidewall 118 that is a surface generated by rotation of a curvilinear element about the nozzle axis 112. In the nozzle 100, the curvilinear element is a portion of an ellipse 120 having a major axis 122 and a minor axis 124, with the major axis 122 being inclined with respect to the nozzle axis 112 by an angle Θ. The portion of the ellipse 120 is positioned such that it is tangent to the nozzle terminal plane 116 at the point where it joins to the distal end face 114 at one end. At the other end, the portion of the ellipse 120 intersects a cylindrical sidewall 126 of the nozzle 100. The segment of the ellipse 120 that forms the curvilinear element is configured to form a continuous variable curve that begins at a minimum inclination with respect to the nozzle axis 112 where it intersects the cylindrical sidewall 126. The inclination increases at an increasing rate with decreasing longitudinal distance from the nozzle terminal plane 116, until the ellipse 120 becomes normal to the nozzle axis 112 and thus tangent to the nozzle terminal plane 116 where the distal region sidewall 118 joins to the distal end face 114, which resides in the nozzle terminal plane 116.

The particular geometry of the distal region sidewall 118 depends on the desired geometry of the surrounding torch components for which the nozzle 100 is designed. The curvature of the ellipse 120 is largely defined by the radius at the point where the distal region sidewall 118 joins the cylindrical sidewall 126, and the desired radius of the distal end face 116. For typical torch components, forming the ellipse 120 having its ratio of the major axis 122 length $L_{Maj}$ to the minor axis 124 length $L_{min}$ in the range of 3.5:1 to 9.6:1 has been found effective, with the lower ratio being found more suitable for lower amperage (e.g., 45 amp) torches, where the shield gas velocities are typically lower, and the higher ratio being found effective for higher amperage (e.g., 260 amp) torches. It is felt that ellipses outside this range such as ellipses with ratios in a range of from 3:1 to 10:1 ,may be practical in some torches. For typical torches, the range of ratios of the axes (122, 124) from 3.5:1 to 9.6:1 has resulted in the major axis 122 being inclined to the nozzle axis 112 such that the angle Θ measures from about 20° (for low ratio ellipses) to about 35° (for high ratio ellipses).

The shield 102 employed with the nozzle 100 in FIG. 2 has an inner gas-directing surface 128 that is conical and is spaced apart from the distal region sidewall 118 of the nozzle 100, forming an annular passage 130 therebetween. Due to the curvature of the distal region sidewall 118, its separation from the gas-directing surface 128 increases as the annular passage 130 approaches the nozzle terminal plane 116. The overall cross-section of the annular passage 130 decreases, as the local diameter of the annular passage 130 decreases; however, such decrease in cross section is less than the decrease found in prior art torches such as that shown in FIG. 1. The shield 102 has a shield orifice 132 that is symmetrically disposed about the nozzle axis 112, and in this embodiment a joint region 134 between the shield orifice 132 and the gas-directing surface 128 is radiused to provide a smooth joint between these surfaces. The smooth joinder of the shield surfaces (128, 132) enhances the effect of the smooth transition between the distal region sidewall 118 and the distal end face 114 in providing a more even, less turbulent distribution of the gas flow to reduce instability of the plasma arc.

The angular passage 130, in addition to directing the flow of shield gas to the plasma arc, passes the shield gas over the distal end region 108 to extract heat therefrom. Heat transfer from the portion that surrounds the nozzle orifice 110 is also provided by conduction to portions of the nozzle 100 that are not exposed to the heat generated by the plasma arc. However, this heat conduction is limited by the minimum thickness t of the nozzle 100. This limitation, due to limited cross section available for heat transfer, can be addressed by selecting a nozzle geometry that increases the minimum thickness, as discussed below with regard to FIG. 4, and/or by employing liquid cooling for the nozzle.

Figure 3:
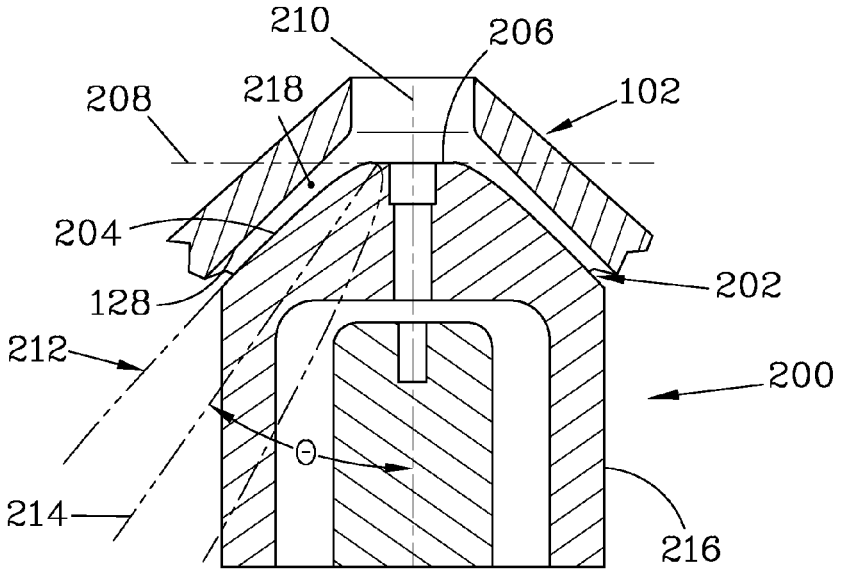
FIG. 3 is a section view illustrating the distal end region of a nozzle that forms another embodiment of the present invention. This nozzle has a distal end region with a variably-curved convex distal region sidewall that is defined by rotation of a portion of a parabola about the nozzle axis. The parabola has its axis of symmetry inclined to the nozzle axis, and the parabola is positioned such that it is substantially tangent to the nozzle terminal plane where it intersects the plane.

FIG. 3 is a section view illustrating a nozzle 200 that forms another embodiment of the present invention. The nozzle 200 again has a distal end region 202 having a variably-curved convex distal region sidewall 204 that is substantially tangent to a distal end face 206 that resides in a nozzle terminal plane 208 that extends normal to a nozzle axis 210. In the nozzle 200, the distal region sidewall 204 is generated by rotation of a curvilinear element about the nozzle axis 210, where the curvilinear element is a portion of a parabola 212 that has a parabola axis 214 that is inclined with respect to the nozzle axis 210 by an angle Θ. The portion of the parabola 212 has a minimum inclination to the nozzle axis 210 at one end where it intersects a cylindrical sidewall 216 of the nozzle 200, and its inclination increases in an increasing manner as it approaches the distal end face 206 so that the joinder of the distal region sidewall 204 and the distal end face 206 is at a location on the parabola 212 where it is tangent to the nozzle terminal plane 208. The particular geometry of the parabola 212 should be such that it provides a contour similar to the range of ellipses discussed above with regard to the ellipse 120 shown in FIG. 2.

The nozzle 200 is illustrated in use with the shield 102 discussed above in the description of FIG. 2, and an annular passage 218 is formed between the gas-directing surface 128 and the distal region sidewall 204. The distal region sidewall 204 curves such that it has an increasing separation from the gas-directing surface 128 as it approaches the distal end face 206.

Figure 4:
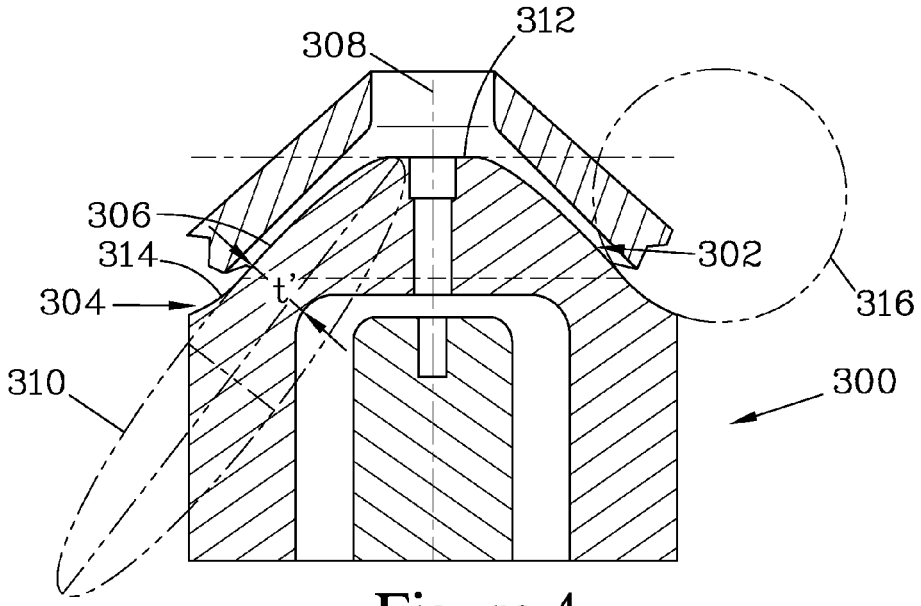
FIG. 4 is a section view of another embodiment of the present invention, a nozzle having a distal end region with a variably-curved convex distal region sidewall defined by rotation of an ellipse about the nozzle axis, which joins to a nozzle extension region that has an extension sidewall; in this embodiment, the extension sidewall is a surface formed by rotation of an extension curvilinear element having an arc, which is tangent to the ellipse that defines the sidewall of the distal end region, so as to provide a concave surface.

FIG. 4 illustrates a nozzle 300 which has a distal end region 302 that joins to an extension region 304 to provide greater freedom of overall design of the nozzle 300. Again, the distal end region 302 has a variably-curved convex distal region sidewall 306 that is a surface generated by rotation of a curvilinear element about a nozzle axis 308. In this embodiment, the curvilinear element is a portion of an ellipse 310, which is configured such that the distal region sidewall 306 is substantially tangent to a distal end face 312 where it joins thereto. The distal region sidewall 306 has its minimum inclination to the nozzle axis 308 where it joins to an extension sidewall 314 of the extension region 304.

The extension sidewall 314 is a surface generated by rotation of an extension curvilinear element about the nozzle axis 308. Preferably, the distal region sidewall 306 and the extension sidewall 314 are configured such that the distal region sidewall 306 is tangent to the extension sidewall 314 where it is joined thereto. In this embodiment, the extension curvilinear element that defines the extension sidewall 314 is a radiused segment of a circle 316 that joins to the distal region sidewall 306, with the extension curvilinear element curving away from the nozzle axis 308 with increasing distance from the distal region sidewall 306. This gives the extension region 304 a concave surface when viewed in section.

For use in gas-cooled torches, the concave configuration provided by the extension sidewall 314 allows the nozzle 300 to have a greater minimum thickness t' compared to the minimum thickness t of the nozzle 100 shown in FIG. 2, thereby increasing the cross-sectional area available for conduction of heat away from the portion of the distal end region 302 that is in close proximity to the plasma arc.

FIG. 5 illustrates a nozzle 400 that forms another embodiment of the present invention, which again has a distal end region 402 with a variably-curved convex distal region sidewall 404. However, the nozzle 400 does not have a distal end face. The distal region sidewall 404 terminates at a nozzle orifice 406, which is symmetrically disposed about a nozzle axis 408. The intersection of the nozzle orifice 406 and the distal region sidewall 404 is a circle forming the end of the nozzle orifice 406 and residing in a nozzle terminal plane 410, which is perpendicular to the nozzle axis 408. Without a distal end face, the cooling gas flow over the surface of the nozzle 400 in close proximity to the nozzle orifice 406 should increase, thus increasing the heat transfer from the portion of the nozzle 400 that is most subject to heating due to its proximity to the plasma arc, and thereby increasing the useful life of the nozzle 400.

The distal region sidewall 404 is defined by rotation of a curvilinear element about the nozzle axis 408, and in the nozzle 400 is defined by a portion of an ellipse 412. The curvilinear element is a variable curve that is configured such that its inclination to the nozzle axis 408 increases in an increasing manner as it approaches the nozzle orifice 406, and is tangent to the nozzle terminal plane 410 where the distal region sidewall 404 terminates at the nozzle orifice 406.

FIG. 6 is an illustration of a nozzle and shield combination 450 that forms another embodiment of the present invention, and which incorporates the nozzle 100 shown in FIG. 2 and discussed above. The nozzle 100 is employed with a shield 452 having a gas-directing surface 454 which is curved, being defined by rotation of a shield curvilinear element about the nozzle axis 112. The shield curvilinear element is a portion of an ellipse 456, and is configured to form an annular passage 458 in combination with the distal region sidewall 118 of the nozzle 100, where the separation between the gas-directing surface 454 and the distal region sidewall 118 increases as the distal region sidewall 118 approaches the nozzle terminal plane 116. While the gas-directing surface 454 is illustrated as a continuous curve, it is frequently preferred in manufacturing and quality control to employ a series of frustoconical facets that approximate such a curved surface.

FIG. 7 is a section view showing a nozzle 500 that forms another embodiment of the present invention, which is shown employed with a deflector 502 rather than with a shield such as is employed in the embodiments discussed above. The deflector 502 extends over only a portion of the nozzle 500.

A distal end region 504 of this embodiment again has a distal region sidewall 506 that is a variably-curved convex surface defined by rotation of a curvilinear element about a nozzle axis 508. Again, the curvilinear element is a variable curve having an inclination to the nozzle axis 508 that increases in an increasing manner as it approaches a nozzle terminal plane 510, until it is substantially tangent at the point where it intersects the nozzle terminal plane 510. In this embodiment, there is no distal end face and the distal region sidewall 506 terminates at a nozzle orifice 512, which in turn terminates at the nozzle terminal plane 510. The curvilinear element in this embodiment is a portion of a primary ellipse 514 having a major axis 516 that is inclined with respect to the nozzle axis 508.

The nozzle 500 also has an extension region 518, having an extension sidewall 520 that is defined by rotation of an extension curvilinear element about the nozzle axis 508. The extension curvilinear element in this embodiment is a portion of a secondary ellipse 522 that has its major axis 524 parallel to the nozzle axis 508, and which intersects the primary ellipse 514 at a point where the ellipses (514, 522) are tangent to each other (as better shown in FIG. 8, where the nozzle 500 is illustrated with a different deflector 502'). The extension sidewall 520 also joins to a cylindrical sidewall 526 of the nozzle 500 in a tangential manner. This configuration provides a smooth transition between the extension region 518 and the distal end region 504 that allows shield gas to follow along the adjoined sidewalls (526, 520, and 506) so as to be directed into close proximity to the nozzle orifice 512.

To initially guide the shield gas along the nozzle 500, the deflector 502 has a gas-directing surface 528 which, in this embodiment, is parallel to the nozzle axis 508 and spaced apart from the cylindrical sidewall 526 and a small portion of the extension sidewall 520 so as to form an annular passage 530. The gas-directing surface 528 terminates at a deflector end face 532, which extends perpendicular to the nozzle axis so as to intersect the gas-directing surface 528 at a right angle. This right angle provides a sharp discontinuity in the surface of the deflector 502, which avoids any tendency of the shield gas to follow this surface beyond the gas-directing surface 528, allowing the gas to follow the curvature of the nozzle 500. Preferably, the deflector 502 extends along the nozzle 500 far enough that the plane in which the deflector end face 532 resides intersects either the extension region 518 or the distal end region 504 of the nozzle 500.

FIG. 8 illustrates the nozzle 500 when employed with an extended deflector 502' to form another embodiment of the present invention. The extended deflector 502' has a gas-directing surface 528' having a deflector surface base region 534, which is a cylindrical surface that is opposed to the cylindrical sidewall 526 of the nozzle 500, and additionally has a deflector surface distal region 536 that is a curved surface defined by rotation of a portion of a third ellipse 538 about the nozzle axis 508, the third ellipse having a major axis 540 that is parallel to the nozzle axis 508. The deflector surface distal region 536 is opposed to a portion of the extension sidewall 520, forming an annular passage 530' for introducing the shield gas in a flow along the nozzle 500. The deflector surface distal region 536 terminates at a deflector end face 532' that is perpendicular to the nozzle axis 508, and thus the deflector surface distal region 536 intersects the deflector end face 532' at an acute angle that serves to prevent the shield gas from following the surface of the deflector 502'

FIG. 9 is a section view showing a nozzle 600 that forms another embodiment of the present invention. The nozzle 600 has a distal end region 602 with a continuously-curved distal region sidewall 604 that terminates at a distal end face 606, where the distal end face 606 resides in a nozzle terminal plane 608 that is perpendicular to a nozzle axis 610. In this embodiment, the distal region sidewall 604 is defined by a portion of an ellipse 612 where the ellipse 612 extends through the nozzle terminal plane 608 rather than intersecting it only at a tangent point as in previously-described embodiments.

The extension of the ellipse 612 intersection through the nozzle terminal plane 608 results in the distal region sidewall 604 intersecting the distal end face 606 at a projection angle $\epsilon$ that is defined by a projection line 614. The projection line 614 is tangent to the ellipse 612 at the point where the distal region sidewall 604 joins the distal end face 606, and the projection angle $\epsilon$ is the inclination of the projection line 614 with respect to the nozzle terminal plane 608. The projection angle ϵ should remain small to assist the shield gas in following the contours of the distal end region 602 such that a portion of the gas remains in close proximity to the distal end face 606; an angle of less than about 15° is felt to be effective.

FIG. 10 illustrates a nozzle 700 which forms another embodiment of the present invention having a distal end region 702 that joins to an extension region 704 to provide a desired overall profile for the nozzle 700. The distal end region 702 has a variably-curved convex distal region sidewall 706, which is a surface generated by rotation of a portion of an ellipse 708 about a nozzle axis 710, and where the distal region sidewall 706 is tangent to a distal end face 712 where it joins thereto.

The extension region 704 of this embodiment has an extension sidewall 714 that is formed by rotation of an inclined line (not shown) about the nozzle axis 710, and thus is frustoconical. The extension sidewall 714 is tangent to the distal region sidewall 706 where it joins thereto.

FIGS. 11 and 12 illustrate a nozzle 750 that forms another embodiment of the present invention, having an overall form similar to that of the nozzle 500 shown in FIGS. 7 and 8, but with a simplified geometry. The nozzle 750 has a distal end region 752 with a distal region sidewall 754 that is symmetrical about a nozzle axis 756. The distal region sidewall 754 is defined by rotation of a portion of an ellipse 758, where the ellipse 758 has a major axis 760 that is oriented parallel to the nozzle axis 756. The ellipse 758 is configured such that it intersects a nozzle terminal plane 762 at a point where the ellipse 758 is normal to the nozzle axis 756, and joins to a cylindrical sidewall 764 of the nozzle 750 at a point where the cylindrical sidewall 764 is tangent to the ellipse 758. The nozzle 750 has a nozzle orifice 766 that terminates at the nozzle terminal plane 762.

In FIG. 11, the nozzle 750 is shown employed in a torch having a deflector 768 that extends over the cylindrical sidewall 764, but which leaves nearly all of the distal end region 752 exposed. FIG. 12 shows the nozzle 750 employed with a shield 770 (only partially shown), which encloses the nozzle 750. The shield 770 has a shield orifice 772, which is aligned with the nozzle orifice 766, and has a gas-directing surface 774 that is spaced apart from the distal region sidewall 754. The curvature of the distal region sidewall 754 causes the separation from the gas-directing surface 774 to increase as the distal region sidewall 754 approaches the nozzle orifice 766.

FIG. 13 illustrates an alternative nozzle 750' which is similar to the nozzle 750 shown in FIGS. 11 and 12, but where the ellipse 758' that defines the distal region sidewall 754' is configured relative to the cylindrical sidewall 764' such that the cylindrical sidewall 764' is not tangent to the ellipse 758'.

FIG. 14 is a schematic representation of the gas flow pattern which results from passing gas through the passage between the nozzle 12 and the shield 20 of the prior art torch 10 shown in FIG. 1; for simplicity, the gas flow is represented prior to the initiation of the plasma arc and the effect of the gas escaping to the surrounding atmosphere is not portrayed. The constraint of the gas in the annular passage 24 formed between the conical exterior surface 16 of the nozzle 12 and the conical interior surface 22 of the shield 20 results in a concentrated gas mass G flowing along the side of the nozzle 12, and which separates from the nozzle 12 at the distal end face 26. This spaced apart relationship of the gas at the distal end face 26 limits the cooling effect on the nozzle 12. Furthermore, the fact that the nozzle 12 has an abrupt change in slope as the gas passes out of the annular passage 24 directs the gas away from the distal end face 26 and provides a substantially focused stream which impacts the plasma arc with a high density gas at a relatively small merge zone M; this concentration of the shield gas can be disruptive to the stability of the plasma arc.

FIG. 15 is schematic representation of a torch employing the nozzle 100 of the present invention, employed with the shield 102 as shown in FIG. 2; again, the view is simplified and does not attempt to portray the effect of the plasma arc or the effect of gas escaping to the surrounding atmosphere. This combination provides a distal end region 108 of the nozzle 100 configured to help maintain the gas passing over the distal end face 114 so as to enhance cooling of the distal end region 108 and distribute the gas flow G' over an extended merge zone M'. This difference results, in part, from the contour of the distal region sidewall 118 of the nozzle 100, which has a smooth continuous convex profile without discontinuities that could deflect the gas away from the distal end face 114 and reduce the ability of the gas to extract heat from the region surrounding the nozzle orifice 110. This continuous circulation over the distal end face 114 is maintained by having the distal region sidewall 118 join the distal end face 114 in a substantially tangent manner. This results in a portion of the shield gas remaining in close proximity to the distal end face 114 to increase the cooling, as well as drawing out the distribution of the gas mass to increase the length of a merge zone M' of the shield gas. The extended merge zone M' distributes the shield gas more evenly where it engages the plasma arc and thus should reduce the disruptive impact on the plasma arc.

Having a rounded corner 134 between the shield orifice 132 and the gas-directing surface 128 of the shield 102 further distributes the flow of the shield gas, as well as smoothing its flow to reduce turbulence. These effects should further reduce instability of the plasma arc.

EXAMPLES

Testing has shown nozzles of the present invention to provide longer useful life and/or improved cut quality compared to conventional nozzles. This enhanced performance is believed to be due to the effect of the elliptical surface in drawing a portion of the shield gas along the nozzle surface, widening the distribution of the gas and reducing its negative impact on the plasma arc by focusing the arc rather than disrupting it. Additionally, drawing the shield gas along the nozzle surface is believed to enhance the cooling effect of the shield gas by extending its contact with the nozzle and providing greater gas flow in close proximity to the nozzle orifice that is exposed to the heat of the arc. This benefit was found in both machine-operated torches and in lower power torches that are typically operated by hand.

Testing was conducted to compare a 260 amp nozzle of the present invention with a prior art 260 amp nozzle; such nozzles are employed in machine operated torches with liquid cooling of the nozzle. The nozzle of the present invention was generally similar to the nozzle 300 shown in FIG. 4, and its general configuration is illustrated in FIG. 16. The nozzle 800 had an extension region 802 with a concave subregion 804, defined by rotation about a nozzle axis 806 of a curvilinear element having a concave 30 mm radius segment, joining to a frustoconical subregion 808 defined by a straight tangent segment inclined at 50° to the nozzle axis 806. The nozzle 800 had a distal end region 810 defined by rotation of a portion of an ellipse 812 about the nozzle axis 806, the ellipse 812 being tangent to the extension region 802 at the joinder thereof. The ellipse 812 in this case had a major axis length $L_{Maj}$ of 33.5 mm and a minor axis length $L_{min}$ of 3.5 mm, for a ratio $L_{Maj}$:$L_{min}$ of 9.6:1, and with the major axis inclined with respect to the nozzle axis of the nozzle by an angle Θ of 32°. The prior art nozzle 820 had the general configuration illustrated in FIG. 17, having a first frustoconical region 822 formed by rotation of a straight segment inclined at 42.5° to a nozzle axis 824, and having a second frustoconical region 826 defined by rotation of a line segment inclined to the nozzle axis 824 by an angle of 50°, without any radius between the regions or between the distal end region and the nozzle face. Both nozzles were employed in the same torch with all other consumable products being identical; the similarity in general profile of the nozzles allowed the same shields to be used in both cases. The torches were employed in two tests each to cut 25 mm thick mild steel at a cut rate of 1.685 M/minute, and the number of standard cuts (890 mm or about 35 inches in length) was measured. The resulting cut quality was equal, but the prior art nozzle was found to have life of 600 cuts in each test, while the nozzle of the present invention incorporating a distal region defined by an ellipse had a life of 700 and 750 cuts, for an average life of 725 cuts, resulting in a 21% increase over the prior art nozzle. The electrode life in this application corresponded to the nozzle life.

A comparison test of similar nozzles was performed under field conditions, cutting mostly ½" (12.5 mm) thick steel plate at 260 amps current. In this test, the nozzle of the present invention lasted for 677 cuts, while the prior art nozzle lasted 495 cuts, indicating a 37% increase in nozzle life, while maintaining a similar quality of cut.

In a preliminary test of a 260 amp nozzle of the present invention, it was noted that the appearance of the hafnium insert of the electrode employed with the nozzle of the present invention differed notably from the appearance of electrodes employed with prior art nozzles. The electrode showed a centered, conical depression extending down into the hafnium. This appeared to indicate a more stable position of the plasma arc on the electrode, which should reduce pitting and thus result in an extended useful life of the electrode.

In another series of tests, a 45 amp nozzle of the present invention was tested against a prior art 45 amp nozzle. These nozzles are employed in torches that are typically hand-held; however, the torch used in testing was machine mounted for accuracy and repeatability. The nozzle of the present invention was similar to that shown in FIG. 10, having a frustoconical extension region and having a distal region defined by rotation of a portion of an ellipse about the nozzle axis, the ellipse being tangent to the extension region at the joinder thereof. In this nozzle, the extension region was defined by a line segment angled at 38° to the nozzle axis, and the distal region was defined by an ellipse having a major axis length $L_{Maj}$ of 11.2 mm and a minor axis length $L_{min}$ of 3.2 mm, for a ratio $L_{Maj}$:$L_{min}$ of 3.5:1, with the major axis being inclined by an angle Θ of 20° to the nozzle axis. The prior art nozzle 840 had the general configuration illustrated in FIG. 18, having an indented, generally frustoconical form with a frustoconical extension region 842 defined by a line segment inclined at 60° to a nozzle axis 844, and having a frustoconical distal end region 846 formed by rotation of a line segment inclined by an angle of 35° to the nozzle axis 844. Again, a series of two tests each was conducted. For these lower amperage nozzles, the test was performed cutting 10 mm thick mild steel at a cut rate of 0.75 M/minute, and the standard cuts were 305 mm (about 12 inches) in length. Both nozzles were employed in the same torch with all other consumable products being identical, with the exception of the shields. The prior art torch employed a shield with a region of the interior surface having a convex-faceted inner gas-directing surface configured to match the concave-faceted contour of the nozzle, and was apparently done to provide uniform gas flow in the passage therebetween. The torch of the present invention employed a shield having an inner gas-directing surface that was a slightly indented faceted surface. Again, the resulting cut quality was equal, but the prior art nozzle was found to have an average life of only 311 cuts, while the nozzle of the present invention had an average life of 1048 cuts, an increase of 237% in life. When the cutting speeds of the two nozzles were compared, the nozzle of the present invention was found to have a slightly higher speed at which the cut quality appeared optimal (0.35 M/min. vs. 0.32 M/min.), and a somewhat higher maximum cutting speed (0.52 M/min. vs. 0.43 M/min.), and had a substantially similar electrode life.

Comparative testing was also done of a 100 amp nozzle of the present invention similar to that shown in FIG. 2, where the distal region sidewall of the nozzle was formed by rotation of an ellipse having a ratio major axis length $L_{Maj}$ to minor axis length $L_{min}$ of 7.5:1. The nozzle was tested against a prior art frustoconical nozzle similar to that shown in FIG. 1. 100 amp nozzles are often employed in machine-operated torches, and the torch employed in testing was machine-mounted. This nozzle has not yet been tested for nozzle life, but was found to provide a visually noticeable higher quality cut than the prior art nozzle, the cut being straighter and smoother, with little or no dross.

Additionally, a comparison was done using computer modeling (COSMOSFloWorks software in combination with SolidWorks modeling and design software) between the 260 amp nozzle configurations discussed above. Gas pressure in the region of the nozzle orifice was studied, with inlet volume and environmental pressure set as boundary conditions.

In this analysis, the conventional angular design was found to have a significant pressure drop at the nozzle front edge, which was not seen in elliptical design. Flow velocity coming into area of the shield orifice was higher for the angular nozzle design, and the distribution of the shield gas was more directional. For the elliptical nozzle design, the flow velocity coming into area of nozzle orifice was lower and the focusing was not so directional. These results are consistent with the gas flows illustrated in FIGS. 14 and 15.

While this invention has been described with respect to its preferred embodiments, it will be understood that various modifications and alterations will occur to those skilled in the art from the detailed description and drawings.

Some examples of these modifications of alterations could be derived from the use of curves that do not conform to a specific geometric form or by a series of arcs or linear segments that approximate a curved path.

It should also be noted that common CNC controls are not capable of producing a perfect ellipse, parabola or hyperbola and that these curves must be produced by the use of a form cutting tool or by linear interpolation. It is desirable that the tool path closely follows the geometry of the desired curve in order to have the intended gas distribution and to keep the gas in contact with the linearly interpolated curved surface. In testing, the linear segments have been limited to 0.30 mm in length and to the naked eye have the appearance of a smooth curve. It should be appreciated that larger segments would still derive some of the benefits of the invention.

What is claimed is:

1. A nozzle for a plasma arc torch that provides a flow of shield gas about a portion of the nozzle, the nozzle comprising:

a nozzle distal end region having, a longitudinal nozzle orifice that is symmetrically disposed about a longitudinal nozzle axis, said nozzle orifice terminating at a nozzle terminal plane which is normal to the nozzle axis, and a distal region sidewall that has a convex form that is symmetrical about the nozzle axis, being defined by rotation of a curvilinear element about the nozzle axis, where the curvilinear element is a curve that terminates at the nozzle terminal plane in a substantially tangential manner and has a smoothly changing curvature and an inclination with respect to the nozzle axis that increases at an increasing rate with decreasing longitudinal distance from the nozzle terminal plane, wherein the curvilinear element is essentially formed as a portion of an ellipse which terminates at the nozzle terminal plane at a point closer in proximity to a terminal end of a major axis of the ellipse than to a terminal end of a minor axis, wherein the ellipse has a major axis length $L_{Maj}$ and a minor axis length $L_{min}$ where the ratio of $L_{Maj}$:$L_{min}$ is between 3:1 and 10:1, whereby the curvature of said distal region sidewall promotes flow of a portion of the shield gas along its surface toward said nozzle orifice.

2. The nozzle of claim 1 wherein said distal region sidewall bounds said nozzle orifice.

3. The nozzle of claim 1 wherein said distal end region of the nozzle further comprises:

a distal end face circumscribing said nozzle orifice and residing in the nozzle terminal plane so as to extend between said nozzle orifice and said distal region sidewall.

4. The nozzle of claim 3 wherein the curvilinear element terminates at said distal end face such that a line tangent to the curvilinear element where the curvilinear element terminates at said distal end face is inclined to said distal end face by an inclination of less than 15°.

5. The nozzle of claim 1 further comprising:

a nozzle extension region having an extension sidewall which is symmetrical about the nozzle axis, said nozzle extension region directly joining to said distal end region of the nozzle such that said extension sidewall joins said distal region sidewall and serves to extend said distal region sidewall away from the nozzle terminal plane.

6. The nozzle of claim 5 wherein said extension sidewall is generated by rotation of an extension curvilinear element that is configured such that the inclination of the extension curvilinear element with respect to the nozzle axis increases with decreasing separation from the nozzle terminal plane.

7. The nozzle of claim 5 wherein said extension sidewall is generated by rotation of an extension curvilinear element having a radiused portion, where the radiused portion forms a concave surface of said extension sidewall and the radiused portion is tangent to the curvilinear element that generates said distal region sidewall at the point where said nozzle extension region joins to said distal end region.

8. The nozzle of claim 5 wherein said extension sidewall is generated by rotation of a line segment that is inclined with respect to the nozzle axis so as to give said extension sidewall a frustoconical form, and where the line segment that generates said extension sidewall is tangent to the curvilinear element that generates said distal region sidewall at the point where said nozzle extension region joins to said distal end region.

9. A nozzle for a plasma arc torch having a torch axis and a gas-directing component having a gas-directing surface that is symmetrically disposed about the torch axis, the nozzle being configured to attach to the plasma arc torch so as to mount at least partially inside the gas-directing component so as to be cooled by a flow of shield gas passed between the nozzle and the gas-directing surface, the nozzle comprising:

a distal end region having, a longitudinal nozzle orifice that is symmetrically disposed about a longitudinal nozzle axis, said nozzle orifice terminating at a nozzle terminal plane which is normal to the nozzle axis;

a distal region sidewall having a convex shape that is symmetrical about the nozzle axis, being defined by rotation of a curvilinear element about the nozzle axis, where the curvilinear element terminates at the nozzle terminal plane in a substantially tangential manner and has a smoothly changing curvature and an inclination with respect to the nozzle axis that increases at an increasing rate with decreasing longitudinal distance from the nozzle terminal plane, wherein the curvilinear element is essentially formed as a portion of an ellipse which terminates at the nozzle terminal plane at a point closer in proximity to a terminal end of a major axis of the ellipse than to a terminal end of a minor axis, wherein the ellipse has a major axis length $L_{Maj}$ and a minor axis length $L_{min}$ where the ratio of $L_{Maj}$:$L_{min}$ is between 3:1 and 10:1, said distal region sidewall being positioned relative to the gas-directing surface of the gas-directing component such that the curvature of said distal region sidewall promotes flow of a portion of the shield gas along its surface toward said nozzle orifice.

10. The nozzle of claim 9 wherein said distal region sidewall bounds said nozzle orifice.

11. The nozzle of claim 9 wherein said distal end region of the nozzle further comprises:

a distal end face circumscribing said nozzle orifice and residing in the nozzle terminal plane so as to extend between said nozzle orifice and said distal region sidewall.

12. The nozzle of claim 11 wherein the curvilinear element terminates at said distal end face such that a line tangent to the curvilinear element where the curvilinear element terminates at said distal end face is inclined to said distal end face by an inclination of less than 15°.

13. The nozzle of claim 9 further comprising:

a nozzle extension region having an extension sidewall which is symmetrical about the nozzle axis, said nozzle extension region directly joining to said distal end region of the nozzle such that said extension sidewall joins said distal region sidewall and serves to extend said distal region sidewall away from the nozzle terminal plane.

14. The nozzle of claim 9 wherein the gas-directing component of the torch is a deflector that extends over a portion of the nozzle and leaves at least a part of said distal region sidewall exposed.

15. The nozzle of claim 9 wherein the gas-directing component of the torch is a shield that encloses the nozzle and has a shield orifice symmetrically disposed about the torch axis, further wherein the gas-directing surface and said distal region sidewall are configured such that the separation therebetween increases as the nozzle terminal plane is approached.

16. A nozzle for a plasma arc torch that provides a flow of shield gas about a portion of the nozzle, the nozzle comprising:

a nozzle distal end region having, a longitudinal nozzle orifice that is symmetrically disposed about a longitudinal nozzle axis, said nozzle orifice terminating at a nozzle terminal plane which is normal to the nozzle axis, and a distal region sidewall that has a convex form that is symmetrical about the nozzle axis, being defined by rotation of a curvilinear element about the nozzle axis, where the curvilinear element has a smoothly changing curvature and an inclination to the nozzle axis that increases at an increasing rate with decreasing longitudinal distance from the nozzle terminal plane, and where the curvilinear element curvature element terminates at the nozzle terminal plane such that a line tangent to the curvilinear element where the curvilinear element terminates at the nozzle terminal plane is inclined to the nozzle terminal plane by an inclination of less than 15°, wherein the curvilinear element is essentially formed as a portion of an ellipse which terminates at the nozzle terminal plane at a point closer in proximity to a terminal end of a major axis of the ellipse than to a terminal end of a minor axis, wherein the ellipse has a major axis length $L_{Maj}$ and a minor axis length $L_{min}$ where the ratio of $L_{Maj}$:$L_{min}$ is between 3:1 and 10:1, whereby the curvature of said distal region sidewall promotes flow of a portion of the shield gas along its surface toward said nozzle orifice.

* * * * *